United States Patent [19]

Hayashi et al.

[11] 4,006,327

[45] Feb. 1, 1977

[54] PNEUMATIC TIRE PRESSURE SENSING SWITCH

[75] Inventors: Tadashi Hayashi, Yokosuka; Isao Nisimura, Nagaokakyo, both of Japan

[73] Assignees: Nissan Motor Co., Ltd., Yokohama; Omron Tateisi Electronics Co., Kyoto, both of Japan

[22] Filed: Jan. 29, 1975

[21] Appl. No.: 545,061

[52] U.S. Cl. ..... 200/61.25; 200/83 P

[51] Int. Cl.[2] ..... H01H 35/24

[58] Field of Search ..... 200/61.25, 83 P, 83 Q, 200/293–296, 61.22; 340/58

[56] References Cited

UNITED STATES PATENTS

| | | | |
|---|---|---|---|
| 3,370,482 | 2/1968 | Mancckc | 200/293 X |
| 3,371,180 | 2/1968 | Frank | 200/296 |
| 3,668,347 | 6/1972 | Korsgren | 200/83 P X |
| 3,860,772 | 1/1975 | Byrd | 200/61.25 X |
| 3,864,537 | 2/1975 | Fiore | 200/61.25 X |
| 3,889,077 | 6/1975 | Hayashi | 200/61.25 |

*Primary Examiner*—James R. Scott
*Attorney, Agent, or Firm*—Frank J. Jordan

[57] ABSTRACT

A pneumatic tire pressure responsive switch wherein the pressure responsive switch is mounted to the tire rim by a snap ring means in a peripheral groove formed around a casing of the pressure responsive switch. The switch actuator is secured to a diaphragm having one side exposed to the inside of a pneumatic tire.

18 Claims, 8 Drawing Figures

PNEUMATIC TIRE PRESSURE SENSING SWITCH

The present invention relates to a wheel and, more particularly to a pressure responsive switch in a device for detecting a drop of pressure existing in a pneumatic tire of the wheel.

It is the main object of the present invention to provide means whereby a pressure responsive switch is easily fixed to the tire rim with sufficient rigidity. Thus the difficulty in mounting the switch to the tire rim due to space limitation is overcome.

It is another object of the present invention to provide a pressure responsive switch which ensures immediate switching when a predetermined pressure value has been reached in a pneumatic tire.

Further object of the present invention is to provide a pressure responsive switch of the above character which is compact and highly sensitive to diaphragm movement in response to variations in pressure existing in a pneumatic tire.

There is proposed a pressure responsive switch which comprises a casing fixed to the tire rim, said casing having a tubular section having one end communicating with the inside of pneumatic tire and the opposite end communicating with the outside of the pneumatic tire; a switch housing mounted in said casing to close said one end of said tubular section, said switch housing having a switch chamber; a diaphragm extending transversely of said tubular section and intermediate the ends thereof, said diaphragm defining a first and a second space inside of said tubular section, said first space being disposed between said switch housing and said diaphragm and communicating with the inside of the pneumatic tire, said second space communicating with the outside of the pneumatic tire; a fixed electrical contact disposed in said switch chamber; a snap action plate having an H-shaped slot formed therein which thereby forms a pair of spaced end legs, a pair of spaced longitudinally contractable springy side legs which connect said end legs, and a pair of aligned central mounting extensible legs which are spaced between said side legs, extending from central portions of said end legs toward each other and spaced at their adjacent ends; a movable electrical contact carried by one of the end legs of said snap action plate; a switch actuator mounted to said switch housing for movement relative thereto; the adjacent ends of said central mounting legs of said snap action plate being operatively connected to said switch actuator so as to be movable thereby on movement of said switch actuator; stop means mounted in said switch chamber for preventing movement of other one of the end legs of said snap action plate out of a plane normal to the movement of said switch actuator; said snap action plate being mounted in said switch chamber and deformable between two principal conditions, one wherein said movable electrical contact is in engagement with said fixed electrical contact and the other wherein said movable electrical contact is out of engagement with said fixed electrical contact; said switch actuator being connected to said diaphragm to be moved thereby in response to variations in pressure in the inside of the pneumatic tire on said diaphragm; an adjustable screw closing said opposite end of said tubular section; and a spring arranged within said second space resting on one side upon said adjustable screw and on the opposite side upon said switch actuator and opposing switch actuator movement in response to an increase in pressure on said diaphragm.

In the pressure responsive switch of the above character conducting paths for the fixed and movable electrical contact are established by the component parts of the switch, one being established by the casing and the other by the adjustable screw, spring, switch actuator and snap action plate. Hence complete electrical insulation between respective parts forming the two electrical conducting paths is necessiated.

Another object of the present invention is therefore to provide a pressure responsive switch of the above character wherein the conducting paths through the component parts are completely insulated and malfunction of switching due to the occurrence of short-circuit is prevented.

Specific object of the present invention is to provide a pressure responsive switch of the above character wherein the spring and switch actuator which are apt to contact the adjacent inner wall of the casing are electrically insulated from the casing.

Another object of the present invention is to provide a pressure responsive switch of the above character wherein rain, humidity and mud are prevented from entering the atmospheric chamber which accommodates therein a diaphragm spring by means of an easily interchangeable apparatus.

Another object of the present invention is to provide a pressure responsive switch of the above character wherein the switch chamber containing the electrical contacts is substantially closed so that the air-flow communication between the switch chamber and the inside of the pneumatic tire is limited.

Another object of the present invention is to provide a pressure responsive switch of the above character which is designed to be easily assembled.

Other objects and advantages of the present invention will be apparent from the following description of a preferred form of the invention, reference being made to the accompanying drawings in which.

Figure 3:
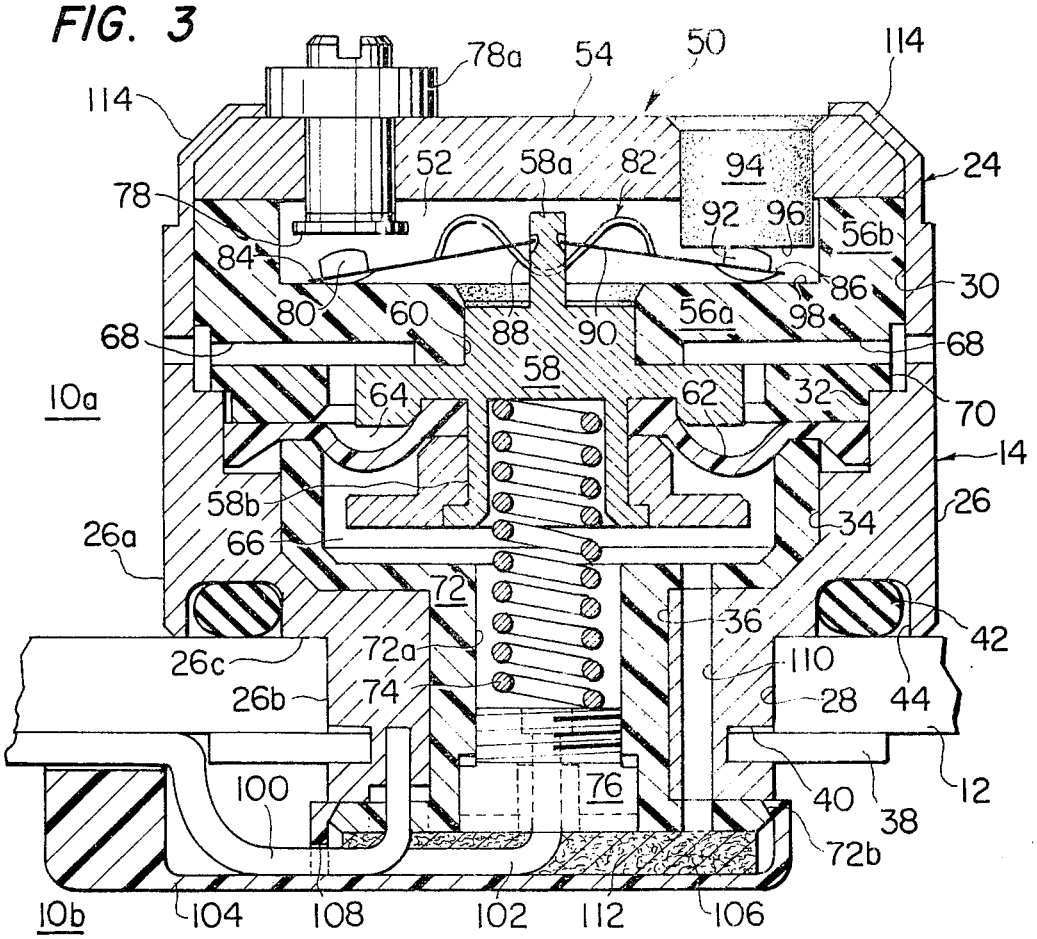
FIG. 3 is an enlarged partial sectional view of the pneumatic tire shown in FIG. 1 showing the positions of component parts of the pressure responsive switch when the pressure in the inside of the tire falls below a predetermined level.
Figure 7:
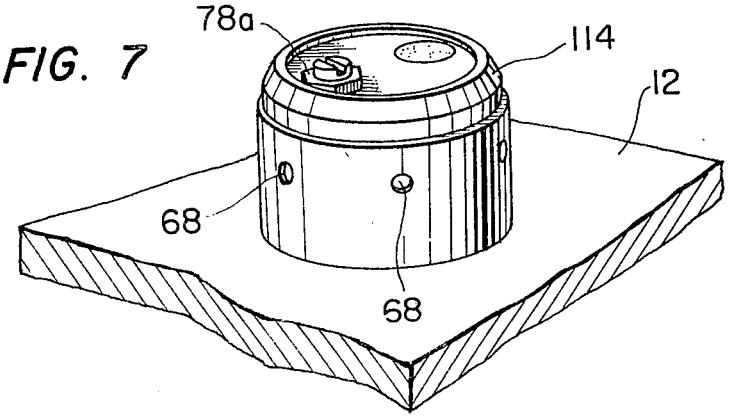
Figure 8:
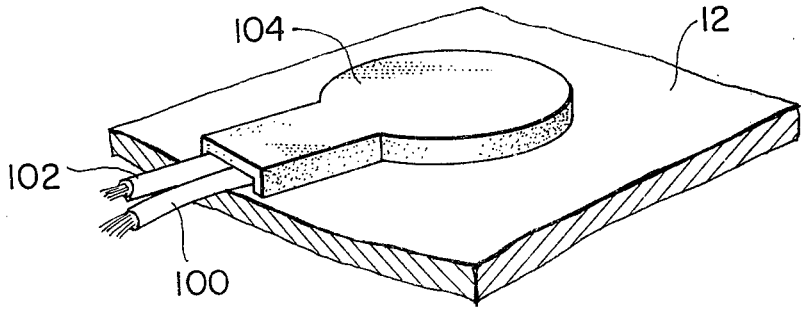

FIG. 7 is a perspective view of the tire rim installed with the pressure responsive switch, as viewed from that side of the tire rim which is exposed to the inside of the tire when the tire is installed, showing a lid of switch housing and caulked portion of the switch of FIG. 3; and FIG. 8 is a perspective view of the opposite side from the side shown in FIG. 7, showing a removable cap member of the switch of FIG. 3.

Figure 1:
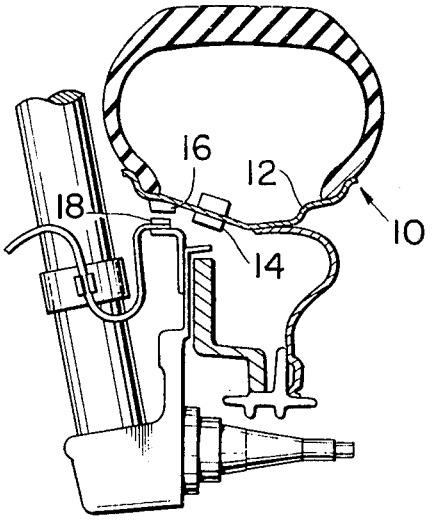
FIG. 1 is an explanatory view of a wheel having a pneumatic tire, showing a pressure responsive switch fixed to a tire rim.
Figure 2:
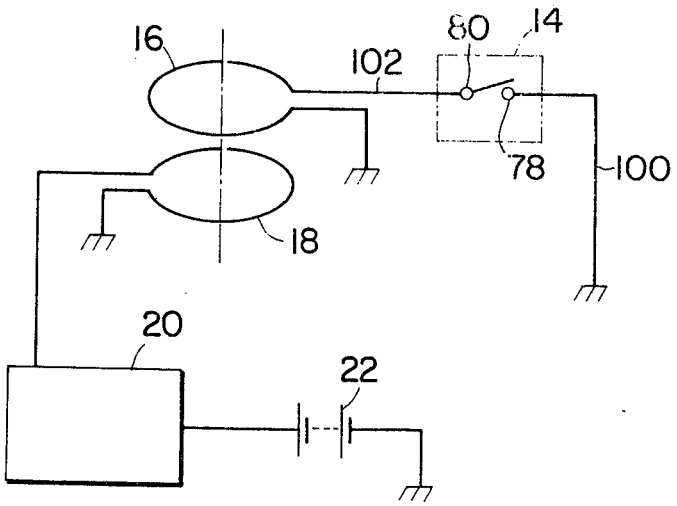
FIG. 2 is an electric circuit diagram of the device for detecting a drop of pressure existing in a pneumatic tire.

Referring to FIG. 1, the reference numeral 10 indicates the cross section of a pneumatic tire in respect of which it is required to ascertain variations, if any, of the inside pressure. The tire 10 is installed to a tire rim 12 in conventional manner to which a pressure responsive switch generally indicated by the reference numeral 14, is fixed. As shown in FIG. 2 the pressure responsive switch 14 is circuited to control a coil 16 rigidly carried to the tire rim 12. The coil 16 is rotatable with the tire rim 12 around a stationary coil 18 which is circuited in series with a warning means 20 and with a D. C. battery 22. A device shown in FIG. 2 is conventional and thus well known to those skilled in the art.

Figure 4:
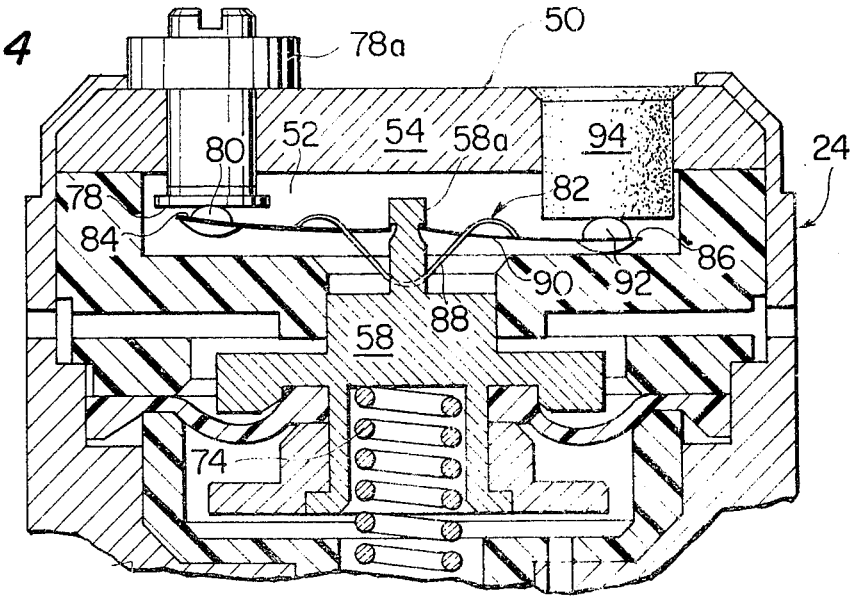
FIG. 4 is a similar view to FIG. 3, showing the positions of the component parts when the inside pressure of the tire is above the predetermined level.

FIGS. 3 and 4 of the drawings illustrate the preferred form of the invention, wherein the pressure responsive switch 14 is constructed so as to maintain a closed electrical circuit by having its electrical contacts engaged (see FIG. 4) when pressure existing in the inside of the penumatic tire 10 is appropriate or above a predetermined level, and wherein reduction of the pneumatic tire pressure below the predetermined level results in disengagement of the electrical contacts in a snap-acting manner, and maintains the electrical contacts disengaged as long as the pneumatic pressure is below the predetermined level.

The switch 14 comprises a casing 24 which is made of an electrically conductive material, such as aluminum. The casing 24 has a tubular section 26 having one end communicating with the inside 10*a* of the pneumatic tire 10 and the opposite end communicating with the outside 10*b* of the tire. The tubular section 26 is constructed of a main cylindrical portion 26*a* and an integral reduced cylindrical portion 26*b* extending from the main cylindrical portion 26*a*. The main cylindrical portion 26*a* is disposed in the inside 10*a* of the tire and the reduced cylindrical portion 26*b* extends through an opening 28 formed in the tire rim 12. The tubular section 26 has a number of coaxial counterbores 30, 32, 34 and 36 formed therein. To fix the casing 24 to the tire rim 12 a snap ring 38 is disposed or fit in a peripheral groove 40 formed around the reduced cylindrical portion 26*b*. An O-ring seal 42 is disposed in a ring groove 44 formed in a shoulder 26*c* which interconnects the main cylindrical portion 26*a* and the reduced cylindrical portion 26*b*, and sealingly contacts that side of the tire rim 12 which is exposed to the inside of the tire 10*a*, thus sealing the tire 10. It will be seen that the shoulder 26*c* and the snap ring 38 cooperate to interpose therebetween the tire rim 12 for rigidly fixing the casing 24 to the tire rim 12.

A switch housing 50 is mounted in the casing 24 to close the one end of the tubular section 26. The switch housing 50 has a switch chamber 52 and it comprises a lid 54 made of an electrically conductive material and a base 56*a* integral with a spacing member 56*b* which is disposed between the lid 54 and the base 56*a*. The base 56*a* and spacing member 56*b* are integral and made of an electrical insulating material. The spacing member 56*b* is of a continuous outline and cooperates with the lid 54 and the base 56*a* to define the switch chamber 52. The switch chamber 52 houses many of the switch elements. The base 56*a* supports a switch actuator 58 which is made of an electrically conductive material. The switch actuator 58 comprises a rod portion 58*a* which is mounted for reciprocating in an opening 60 formed through the base 56*a* and a spring retainer 58*b*, and it is secured to a diaphragm 62 to be actuated thereby.

The diaphragm 62 extends transversely of the tubular section 26 and intermediate the ends thereof and defines a first space 64 and a second space 66 inside of the tubular section 26. The first space 64 is disposed between the switch housing 50 and the diaphragm 62 and communicates with the inside 10*a* of the pneumatic tire 10 through radial passageways 68. The diaphragm 62 is peripherally clamped between an annular spacer 70 which is disposed in the first space 64 and between the base 56*a* and the diaphragm 62 and an electrically insulating wall structure 72 which surrounds the second space 66. A metal spring 74 is arranged within the second space 66 and rests on one side upon an adjustable screw 76 and on the opposite side upon the spring retainer 58*b* of the switch actuator 58. Thus the switch actuator 58 is moved by the diaphragm 62 in response to variations in pressure in the inside 10*a* of the pneumatic tire 10 on the diaphragm 62. The adjustable screw 76 is threaded into a bore 72*a* of the electrical insulating wall structure 72 and is adjustable to assume the load on the diaphragm 62 by the spring 74.

Figure 6:
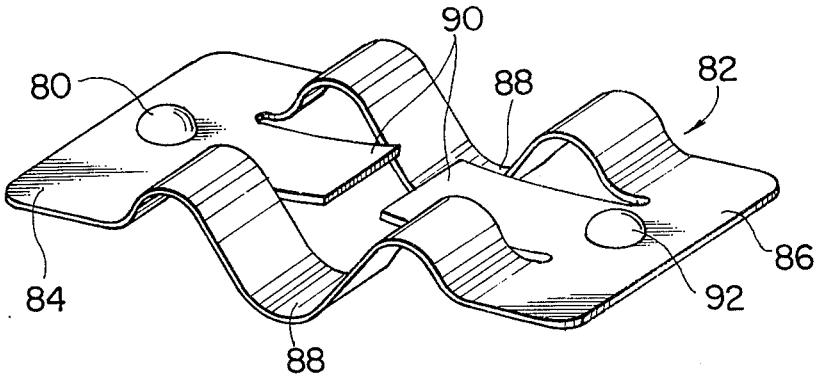
FIG. 6 is a perspective view of a snap action plate used in the switch shown in FIG. 3.

Mounted to the switch housing 50 are a fixed electrical contact 78, a movable electrical contact 80 which is preferably rounded, and a snap action plate 82. The fixed electrical contact 78 is mounted to the lid 54. The snap action plate 82 preferably comprises a formed slotted plate made of a thin, flexible, deformable material, such as those materials that metallic leaf springs are made of. As can best be seen in FIG. 6, the plate 82 has an H-shaped slot formed therein which thereby forms a pair of spaced end legs 84 and 86, a pair of spaced longitudinally contractable springy side legs 88 which connect the end legs 84 and 86, and a pair of aligned central mounting extensible legs 90 which are spaced between the side legs 88, extend from central portions of the end legs 84 and 86 toward each other and spaced at their adjacent ends. The end leg 84 rigidly supports the movable electrical contact 80. The central legs 90 mount the entire snap action plate 82 within the switch chamber 52 on the rod portion 58*a* of the switch actuator 58 by having their opposed ends received in the grooves formed in the rod portion 58*a*. To prevent movement of the opposite end leg 86 of the snap action plate 82 out of a plane normal to the movement of the rod portion 58*a* of the switch actuator 58 stop means is mounted to the switch housing 50. The stop means comprises a rounded member 92 rigidly carried by the end leg 86 of the snap action plate 82 and an electrical insulating stud 94 extending from the lid 54 toward the base 56*a*. The stud 94 and the base 56*a* having opposed surfaces 96 and 98 spaced from each other. When fully mounted the snap action plate 82 is disposed so as to have the electrical contact 80 which it supports oriented to engage and disengage with the fixed electrical contact 78 by having the rounded member 92 slidably disposed between the opposed surfaces 96 and 98 of the stud 94 and the base 56*a*. The contacts-disengaged condition of the snap action plate 82 and its associated switch elements when the pressure in the inside of the tire 10 is below the predetermined level is shown in FIG. 3, and the contacts-engaged condition of the snap action plate 82 and its associated switch elements when the tire pressure is above the predetermined level is shown in FIG. 4.

The pressure responsive switch 14 is wired in circuit of FIG. 2 by having one lead 100 press fit to the casing 24 and the other lead 102 press fit to the adjustable screw 76 as shown in FIG. 3. The casing 24 is in contact with the fixed electrical contact 78 through the lid 54 and a contact carrier 78*a*, serving as a conducting path. The adjustable screw 76, the spring 74, the switch actuator 58 and the snap action plate 82 which are connected one after another, serve as a conducting path for the movable electrical contact 80. It will be understood that the insulating wall 72 surrounding the second space 66 prevents the spring retainer portion 58*b* of the switch actuator 58, the spring 74 and the adjustable screw 76 from contacting the casing 24 and thus occurrence of short-circuit between the above two conducting paths is eliminated.

A cap member 104 which is made of an electrical insulating material is removably retained to that axial end of the casing 24 which faces radially inwardly the tire rim 12 by snapping the cap member 104 to an annular plate 72*b* integral with the insulating wall 72 and overlapping the axial end. The cap member 104 and the annular plate 72*b* cooperate to form an air flow chamber 106 having an inlet 108 opening in a direction along the tire rim 12 (see FIG. 8). The casing 24 has formed an air passageway 110 extending therethrough. The air passageway 110 communicates at one end with the second space 66 and at the opposite end with the air flow chamber 106. It will therefore be understood that the ambient air flows into the second space 66 through the inlet 108, air flow chamber 106 and air passageway 110. It will also be understood that the cap member 104 prevents rain and mud from entering the air passageway 110 because the inlet 108 opens in the direction along the tire rim 12. To eliminate humidity in the ambient air and to keep the second space 66 dry an air filter means 112 which is made of a water-repellant fabric, such as a felt, fills the air flow chamber 106.

Figure 5:
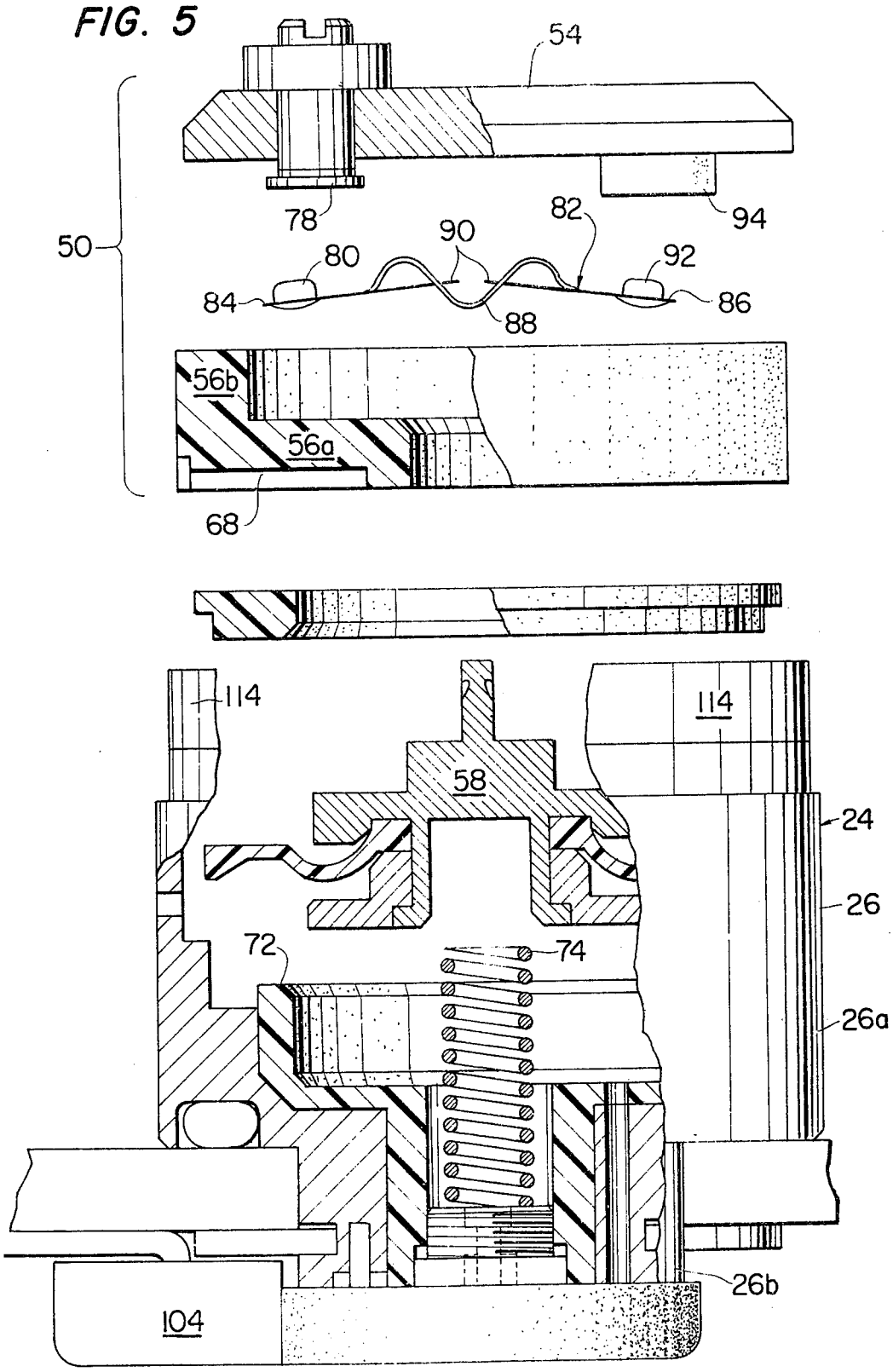
FIG. 5 is an exploded disassembled view of the pressure responsive switch shown in FIG. 3.

As will be readily understood from FIG. 5, when assembling the pressure responsive switch 14, the insulating wall structure 72, the annular spacer 70 and the switch housing 50 are stacked one after another in the tubular section 26 of the casing 24 and an annular portion 114 extending from the tubular section is finally caulked as best seen in FIG. 7 to press the switch housing 50 toward the annular spacer 70. Thus the component parts of the pressure responsive switch 14 are assembled without difficulty.

The operation of the pressure responsive switch 14 is as follows:

When the pressure prevailing in the first space 64 and applied to the diaphragm 62 is above a predetermined level, the diaphragm 62 spreads out or folds over and have the switch actuator 58 to assume positions against the action of the spring 74 wherein the snap action plate 82 keeps the contacts-engaged condition (see FIG. 4). When the tire air pressure reduces below the predetermined level, such as on account of the leak, the diaphragm 62 allows the spring 74 to bias the switch actuator 58 until the snap action plate snaps from the position of FIG. 4 to the position of FIG. 3. It will be observed that the rounded member 92 slides within a plane normal to the movement of the switch actuator 58 when the snap action plate 82 is deformed the contacts-disengaged condition and the contacts-engaged condition.

The pressure responsive switch 14 possesses several advantages. Of primary importance is the disposition of the snap action plate provided by the stop means and the switch actuator. This disposition assures increased sensitibity to the diaphragm movement and compact construction. The stop means allows the snap action plate to smoothly snap between the contacts-engaged condition and the contacts-disengaged condition in response to the movement of the switch actuator. It will also be understood that sufficient contact force is produced with relatively thin plate due to this disposition.

Another advantage of the pressure responsive switch is its self-cleaning capabilities. The preferably rounded movable electrical contact ridigly carried to the snap action plate rocks and thereby wipe the fixed electrical contact of the switch housing, causing any deposit to be broken.

It is to be understood that the following claims are intended to cover all of the generic and specific features of the present invention herein described, and all statements of the scope of the present invention which, as a matter of languages, might be said to fall therebetween.

What is claimed is:

1. A pneumatic tire sensor switch comprising:

a casing having a tubular section, said tubular section having one end and an opposite end;

a switch housing having a switch chamber mounted in said casing to close said one end of said tubular section;

a diaphragm extending transversely of said tubular section, said diaphragm defining a first and a second space inside of said tubular section, said first space being disposed between said switch housing and said diaphragm, said first space being adapted to communicate with the inside of a pneumatic tire, said second space being adapted to communicate with the ambient atmosphere;

a switch actuator mounted to said switch housing for movement relative thereto, said switch actuator being connected to said diaphragm to be moved thereby in response to variations in pressure in said first space;

means comprising an adjustable screw closing said opposite end of said tubular section;

a spring arranged within said second space resting on one side upon said adjustable screw and on the opposite side upon said switch actuator and opposing switch actuator movement in response to an increase in pressure on said diaphragm;

a fixed electrical contact disposed in said switch chamber;

a snap action plate having an H-shaped slot formed therein which thereby forms a pair of spaced end legs, a pair of spaced longitudinally contractable springy side legs which connect said end legs, and a pair of aligned central mounting extensible legs which are spaced between said side legs, which extend from central portions of said end legs toward each other, and which are spaced at their adjacent ends;

a movable electrical contact carried by one of the end legs of said snap action plate;

said adjacent ends of said central mounting legs of said snap action plate being operatively connected to said switch actuator so as to be movable thereby on movement of said switch actuator;

stop means mounted in said switch chamber for preventing movement of the other one of said end legs of said snap action plate out of a plane normal to the movement of said switch actuator;

said snap action plate being mounted in said switch chamber and deformable between two principal conditions, one wherein said movable electrical contact is in engagement with said fixed electrical contact and the other wherein said movable contact is out of engagement with said fixed electrical contact; and said adjustable screw, said spring, said switch actuator and said snap action plate being made of an electrically conductive material and serving as a conducting path for said movable electrical contact.

2. A pneumatic tire sensor switch as claimed in claim 1, in which said switch housing comprises a lid made of an electrically conductive material and a base integral with a spacing member which is disposed between said lid and said base, said base and said spacing member being made of an electrically insulating material.

3. A pneumatic tire sensor switch as claimed in claim 2, in which said spacing member is of continuous outline and cooperates with said lid and said base to define said switch chamber.

4. A pneumatic tire sensor switch as claimed in claim 3, in which said base has an opening therethrough, and said switch actuator extends through said opening in said base to close said opening.

5. A pneumatic tire sensor switch as claimed in claim 2, in which said fixed electrical contact is attached to said lid.

6. A pneumatic tire sensor switch as claimed in claim 2, in which said stop means comprises a rounded member carried by the other one of said end legs of said snap action plate and an electrically insulating stud extending from said lid toward said base, said stud and said base having opposed surfaces, said rounded member being slidably disposed between said opposed surfaces of said stud and said base.

7. A pneumatic tire sensor switch comprising:

a casing having a tubular section, said tubular section having one end and an opposite end;

a switch housing having a switch chamber mounted in said casing to close said one end of said tubular section;

a snap action switch means in said switch chamber and operable between a closed and an open position;

a diaphragm extending transversely of said tubular section, said diaphragm defining a first and a second space inside of said tubular section, said first space being disposed between said switch housing and said diaphragm, said first space being adapted to communicate with the inside of a pneumatic tire, said second space being adapted to communicate with the ambient atmosphere;

a switch actuator mounted to said switch housing for movement relative thereto, said switch actuator being connected to said diaphragm to be moved thereby in response to variations in pressure in said first space;

means comprising an adjustable screw closing said opposite end of said tubular action;

a spring arranged within said second space resting on one side upon said adjustable screw and on the opposite side upon said switch actuator and opposing switch actuator movement in response to an increase in pressure on said diaphragm;

an electrical insulating wall structure surrounding said second space; and said adjustable screw, said spring, said switch actuator and said snap action switch means being made of an electrically conductive material and serving as an electrical conducting path when said snap action switch means is closed.

8. A pneumatic tire sensor switch as claimed in claim 7, in which a fixed electrical contact is mounted on said casing, said casing being in contact with said fixed electrical contact and serving as an electrical conducting path when said snap action spring means is in said closed position.

9. A pneumatic tire sensor switch as claimed in claim 7, in which said wall structure is integral with said casing.

10. A pneumatic tire sensor switch as claimed in claim 7, in which said wall structure has a threaded bore into which said adjustable screw is adjustably screwed.

11. A pneumatic tire sensor switch as claimed in claim 7, further comprising an annular spacer made of electrically insulating material disposed in said first space between said switch housing and said diaphragm.

12. A pneumatic tire sensor switch as claimed in claim 11, in which said annular spacer and said insulating wall structure cooperate with each other to clamp a peripheral portion of said diaphragm.

13. A pneumatic tire sensor switch comprising:

a casing having a tubular section, said tubular section having one end and an opposite end;

a switch housing having a switch chamber mounted in said casing to close said one end of said tubular section;

a snap action switch means in said switch chamber and operable between a closed and an open position;

a diaphragm extending transversely of said tubular section, said diaphragm defining a first and a second space inside of said tubular section, said first space being disposed between said switch housing and said diaphragm, said first space being adapted to communicate with the inside of a pneumatic tire, said second space being adapted to communicate with the ambient atmosphere;

a switch actuator mounted to said switch housing for movement relative thereto, said switch actuator being connected to said diaphragm to be moved thereby in response to variations in pressure in said first space;

means comprising an adjustable screw closing said opposite end of said tubular section;

a spring arranged within said second space resting on one side upon said adjustable screw and on the opposite side upon said switch actuator and opposing switch actuator movement in response to an increase in pressure on said diaphragm;

said adjustable screw, said spring, said switch actuator and said snap action switch means being made of an electrically conductive material and serving as an electrical conducting path when said snap action switch means is in a closed position;

a cap removably retained to said casing and cooperating with said casing to form an air flow chamber having an inlet; and an air passageway extending through said casing and communicating at one end with said second space and at the opposite end with said air flow chamber.

14. A pneumatic tire sensor switch as claimed in claim 13, in which air filter means fill said air flow chamber.

15. A pneumatic tire sensor switch as claimed in claim 14, in which said air filter means is made of a water-repellent fabric.

16. A pneumatic tire sensor switch as claimed in claim 15, in which said water-repellent fabric is a felt material.

17. The combination comprising:

a pneumatic tire and a tire rim having an opening;

a snap ring; and a pneumatic tire sensor switch comprising a casing of rigid material having a tubular section, said tubular section having one end and an opposite end, said tubular section having a main portion and an integral reduced diameter portion connected to said main portion by an annular shoulder, said main portion having said one end of said tubular section, said integral reduced diameter portion being said opposite end of said tubular section, said integral reduced diameter portion being formed with a peripheral groove therearound, said pneumatic tire sensor switch being mounted in said opening with said integral reduced diameter portion extending through said opening and with said annular shoulder abutting against the interior side of said tire rim, said snap ring fitting in said peripheral groove and abutting against the exterior side of said tire rim;

a switch housing having a switch chamber mounted in said casing to close said one end of said tubular section;

a diaphragm extending transversely of said tubular section, said diaphragm defining a first and a second space inside of said tubular section, said first space being disposed between said switch housing and said diaphragm and communicating with the inside of said pneumatic tire so that air pressure in the inside of said pneumatic tire is imposed to said first space, said second space communicating with the ambient atmosphere so that atmospheric pressure is imposed to said second space;

a switch actuator mounted to said switch housing for movement relative thereto, said switch actuator being conducted to said diaphragm to be moved thereby in response to variations in pressure in said first space;

means comprising an adjustable screw closing said opposite end of said tubular section;

a spring arranged within said second space resting on one side upon said adjustable screw and on the opposite side upon said switch actuator and opposing switch actuator movement in response to an increase in pressure on said diaphragm;

a fixed electrical contact disposed in said switch chamber;

a snap action plate having an H-shaped slot formed therein which thereby forms a pair of spaced end legs, a pair of spaced longitudinally contractable springy side legs which connect said end legs, and a pair of aligned central mounting extensible legs which are spaced between said side legs, which extend from central portions of said end legs toward each other, and which are spaced at their adjacent ends;

a movable electrical contact carried by one of the end legs of said snap action plate;

the adjacent ends of said central mounting legs of said snap action plate being operatively connected to said switch actuator so as to be movable thereby on movement of said switch actuator;

stop means mounted in said switch chamber for preventing movement of the other one of said end legs of said snap action plate out of a plane normal to the movement of said switch actuator;

said snap action plate being mounted in said switch chamber and deformable between two principal conditions, one wherein said movable electrical contact is in engagement with said fixed electrical contact and the other wherein said movable contact is out of engagement with said fixed electrical contact; and said adjustable screw, said spring, said switch actuator and said snap action plate being made of an electrically conductive material and serving as an electrical conducting path when said movable electrical contact is in engagement with said fixed electrical contact.

18. The combination as claimed in claim 17, further comprising an O-ring seal disposed between said annular shoulder and said interior side of said tire rim around said opening.

* * * * *